US005337954A

United States Patent [19]

Kobilarcik et al.

[11] Patent Number: 5,337,954

[45] Date of Patent: Aug. 16, 1994

[54] MAILBOX MOUNTING BRACKET

[75] Inventors: Albert T. Kobilarcik, Wooster; William T. Stephens, Norton, both of Ohio

[73] Assignee: Rubbermaid Incorporated, Wooster, Ohio

[21] Appl. No.: 920,041

[22] Filed: Jul. 27, 1992

[51] Int. Cl.[5] ..... B65D 91/00

[52] U.S. Cl. ..... 232/38; 232/39

[58] Field of Search ..... 232/17, 38, 39; 248/219.2, 207, 220.2

[56] References Cited

U.S. PATENT DOCUMENTS

| | | | |
|---|---|---|---|
| 2,552,915 | 4/1950 | Zachrich | 232/39 |
| 3,081,023 | 3/1963 | Taylor | 232/24 |
| 4,146,171 | 3/1979 | Hodge | 232/39 |
| 4,147,292 | 4/1979 | Fisher | 232/35 |
| 4,236,665 | 12/1980 | Glass | 232/39 |
| 4,367,844 | 1/1983 | Drummond | 232/17 |
| 4,496,123 | 1/1985 | Laramie | 232/38 |
| 4,709,853 | 12/1987 | Hahn | 232/39 |
| 4,792,088 | 12/1988 | Bonnell | 232/39 |
| 4,893,747 | 1/1990 | Roth | 232/39 |
| 4,955,534 | 9/1990 | Raible | 232/39 |
| 5,060,900 | 10/1991 | Kokoruda et al. | 232/39 |
| 5,119,986 | 6/1992 | Kobilarcik et al. | 232/35 |

*Primary Examiner*—Hien H. Phan

*Attorney, Agent, or Firm*—Renner, Kenner, Greive, Bobak, Taylor & Weber

[57] ABSTRACT

A bracket (10) is utilized to mount a mailbox (11) to a wide variety of stanchion configurations (39, 41, 42). The bracket (10) includes opposed side walls (18), opposed end walls (20) and a bottom surface which includes rib members (25). Spaced flanges (35) depend from the bottom of the rib members (25) and have aligned bores (37) therein permitting the bracket (10) to be mounted to a stanchion (42) of one configuration. Apertures (38) in the flanges (35) permit the bracket (10) to be mounted to stanchions (39, 41) of other configurations. Lug members (22) on the side walls (18) are received in apertures (55) in flanges (48) depending from the bottom wall (47) of the mailbox (11) to attach the mailbox (11) to the bracket (10). Holes (56) formed in the flanges (48) and holes (57) formed in additional flanges (52) depending from the bottom wall (47) of the mailbox (11) allow the mailbox (11) to be directly affixed to various stanchion configurations.

16 Claims, 4 Drawing Sheets

MAILBOX MOUNTING BRACKET

TECHNICAL FIELD

This invention relates to a bracket for mounting a mailbox to a stanchion. More particularly, this invention relates to a bracket which is universally adapted to be mounted to stanchions of essentially any configuration. More specifically, this invention relates to such a bracket which, when once mounted on the stanchion, can receive a complementally configured mailbox without the need for any additional fasteners.

BACKGROUND ART

The mounting of mailboxes on a post or other stanchion has always been a tedious task. Such is especially the case when one attempts to mount a new mailbox on an existing post. In these situations the user is limited in mailbox selection because he must first locate a mailbox which will be suitable for mounting on the existing post. Then it is inevitable that the new mailbox will not be totally adaptable to the existing post thereby requiring jury-rigging to mount the mailbox, usually resulting in an unstable mounting.

The identical problems exist if one needs a new post for an existing mailbox and can even be encountered when new posts and mailboxes are purchased as a unit. In this latter instance, no system has been devised to easily mount the mailbox to the post without the need for additional fasteners and tedious positioning maneuvers.

Another problem with mailboxes that are permanently attached to stanchions is that if the mailbox is struck, it is often damaged resulting in the need to be replaced. Thus, the need persists for a bracket which can be easily attached to most any stanchion, which can carry most types of mailboxes, and which will release the mailbox upon a blow thereto, thereby minimizing damage to the mailbox.

DISCLOSURE OF THE INVENTION

It is thus a primary object of the present invention to provide a bracket which is adapted to mount a mailbox to a stanchion of essentially any conventional configuration.

It is another object of the present invention to provide a bracket, as above, which will readily receive most any conventional mailbox.

It is a further object of the present invention to provide a bracket, as above, which is particularly suited to receive a complementally configured mailbox without the need for additional fasteners.

It is an additional object of the present invention to provide a bracket, as above, which will readily release the mailbox should the mailbox be struck, thereby minimizing damage to the mailbox.

These and other objects of the present invention, as well as the advantages thereof over existing prior art forms, which will become apparent from the description to follow, are accomplished by the improvements hereinafter described and claimed.

In general, the present invention relates to a bracket which, when combined with a mailbox, enables the mailbox to be attached to a stanchion. The bracket includes opposed side walls, opposed end walls and a bottom surface. Means depending from the bottom surface of the mailbox enable the bracket to be attached to the stanchion. Additional means formed on at least one of the walls enables the bracket to be attached to the mailbox.

A preferred exemplary mailbox mounting bracket incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
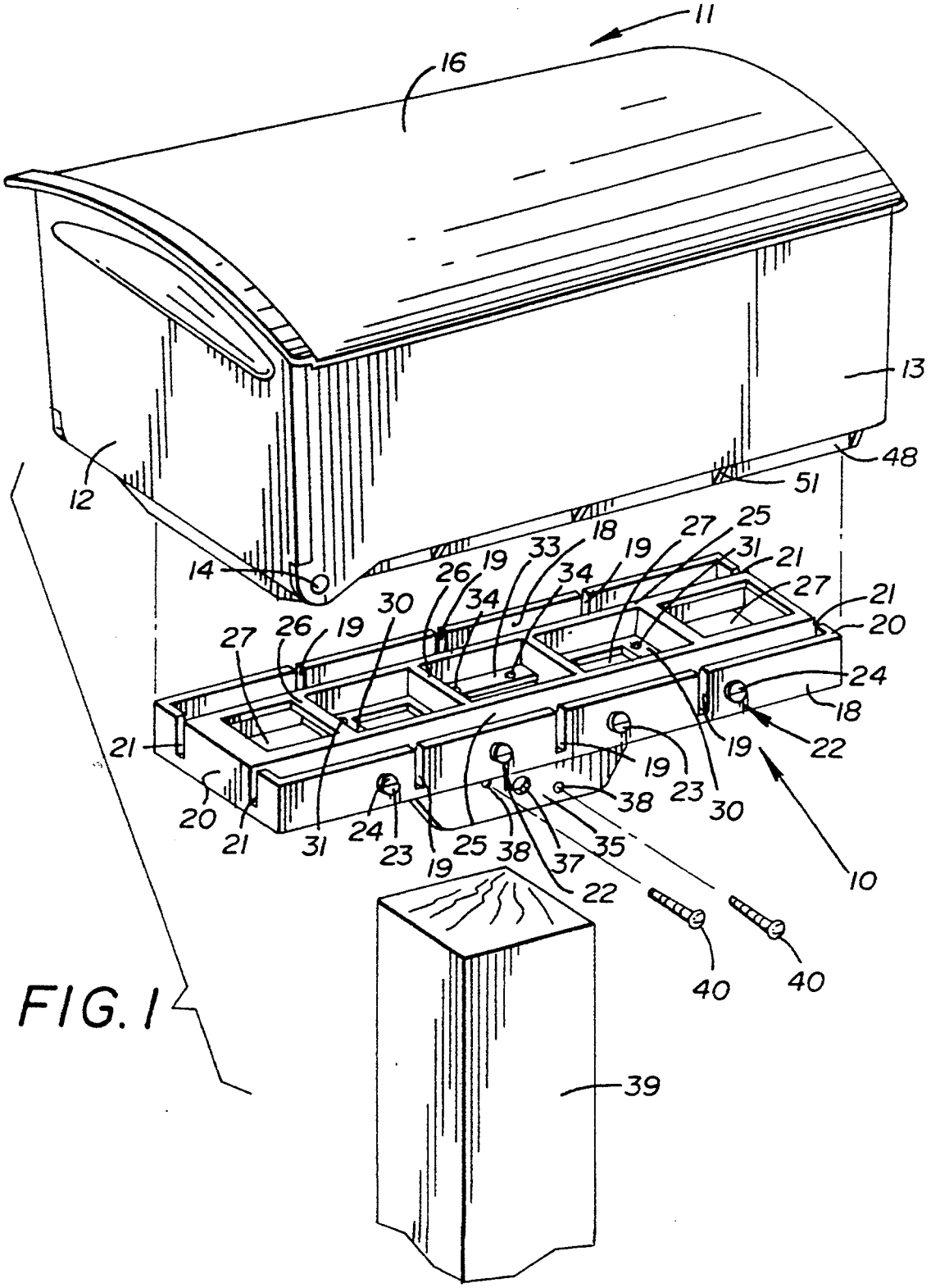
FIG. 1 is an exploded perspective view showing a mailbox and a mounting bracket made in accordance with the concepts of the present invention, the bracket shown as being affixable to a stanchion in the form of a conventional solid square post.
Figure 2:
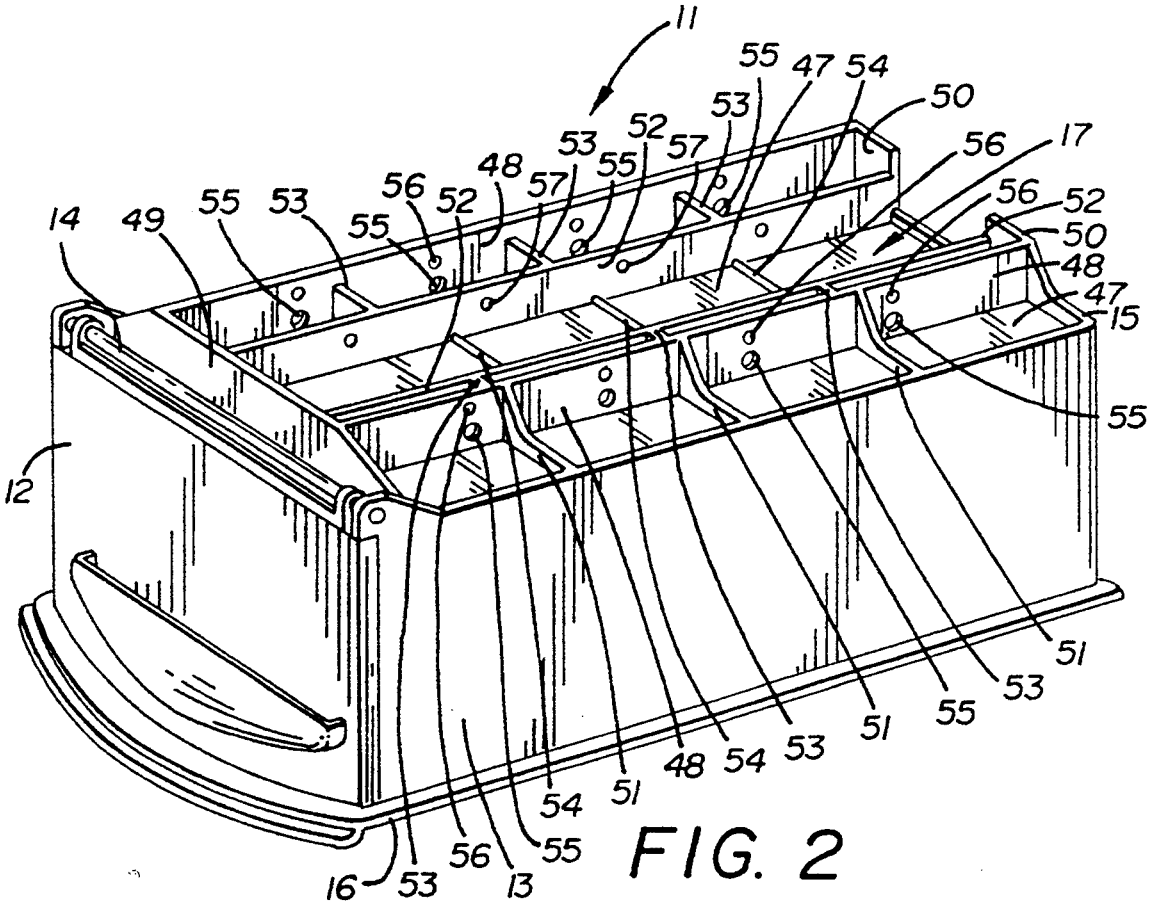
FIG. 2 is a perspective view showing the bottom of the mailbox depicted in FIG. 1.

A mailbox mounting bracket is indicated generally by the numeral 10 in the drawings and is shown in conjunction with a mailbox indicated generally by the numeral 11. Mailbox 11 is depicted in FIG. 1 as being a rather conventional receptacle to receive mail having a door 12 pivotally connected to side walls 13, as by pivot rod member 14, a rear wall 15 (FIG. 2), and a top wall 16 traversing side walls 13 and rear wall 15. However, as shown in FIG. 2, mailbox 11 includes a bottom surface, generally indicated by the numeral 17, having a unique configuration to be hereinafter described.

Bracket 10, which may be formed entirely of a suitable plastic material such as polypropylene, includes longitudinally extending and laterally spaced side walls 18 having a plurality of longitudinally spaced notches 19 (three shown) therein which open at the top of side walls 18. End walls 20 extend laterally between side walls 18 at the ends thereof and are likewise provided with a plurality of spaced notches 21 which open at the top of end walls 20. A plurality of spaced lug members, generally indicated by the numeral 22, are shown as extending laterally outwardly from each side wall 18. Each lug member 22 includes an outer generally flat surface 23, being generally parallel to side walls 18, and a tapered surface 24 extending angularly inwardly and upwardly from flat surface 23 to side wall 18. In a manner to be hereinafter described, lug members 22 are adapted to attach mailbox 11 to bracket 10.

Bracket 10 is also provided with rib members 25 longitudinally extending between end walls 20 and spaced laterally inwardly from, and generally parallel to, side walls 18. Lateral rib members 26 are longitudinally spaced and extend between rib members 25, thereby forming a plurality of compartments 27 which are open at the tops and bottoms thereof to effect a saving of material, the structural rigidity of bracket 10 being sufficiently maintained by rib members 25 and 26.

The top surface of bracket 10 is thus defined by the top of side walls 18, the top of end walls 20, and the top of rib members 25 and 26.

Figure 3:
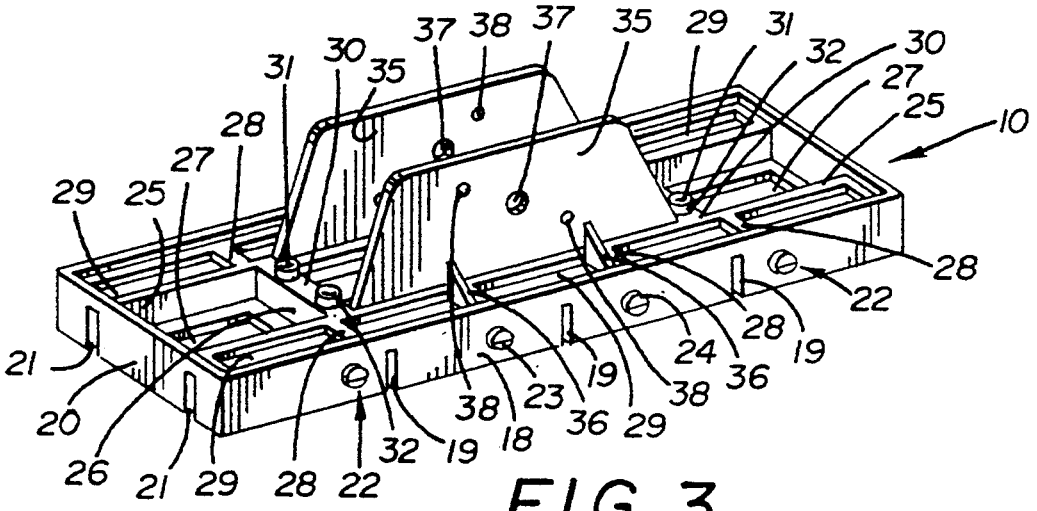
FIG. 3 is a perspective view showing the bottom of the mounting bracket depicted in FIG. 1.
Figure 4:
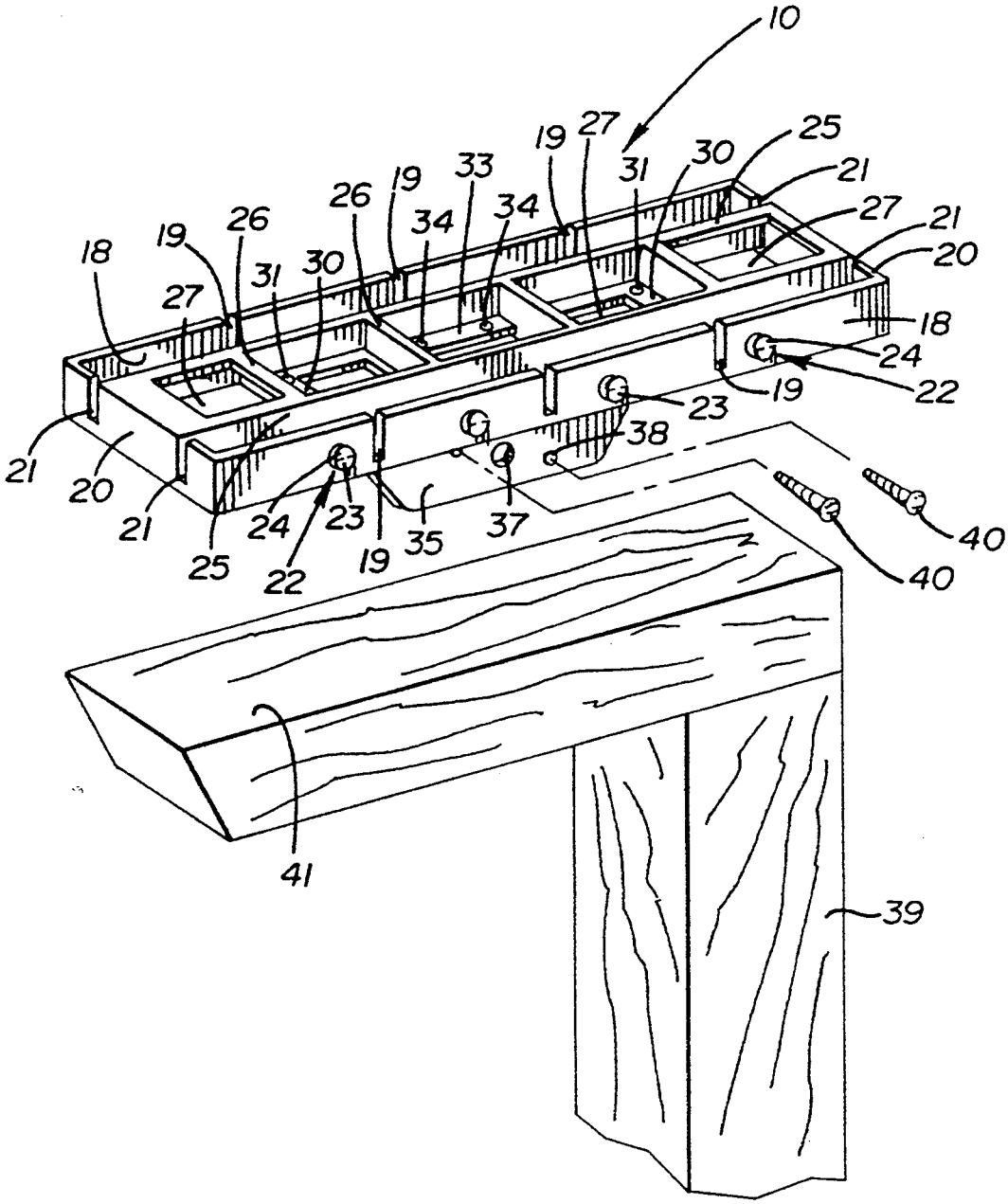
FIG. 4 is an exploded perspective view showing the mounting bracket depicted in FIG. 1 and a stanchion in the form of a post with a horizontal cross-arm extending from the top thereof.
Figure 5:
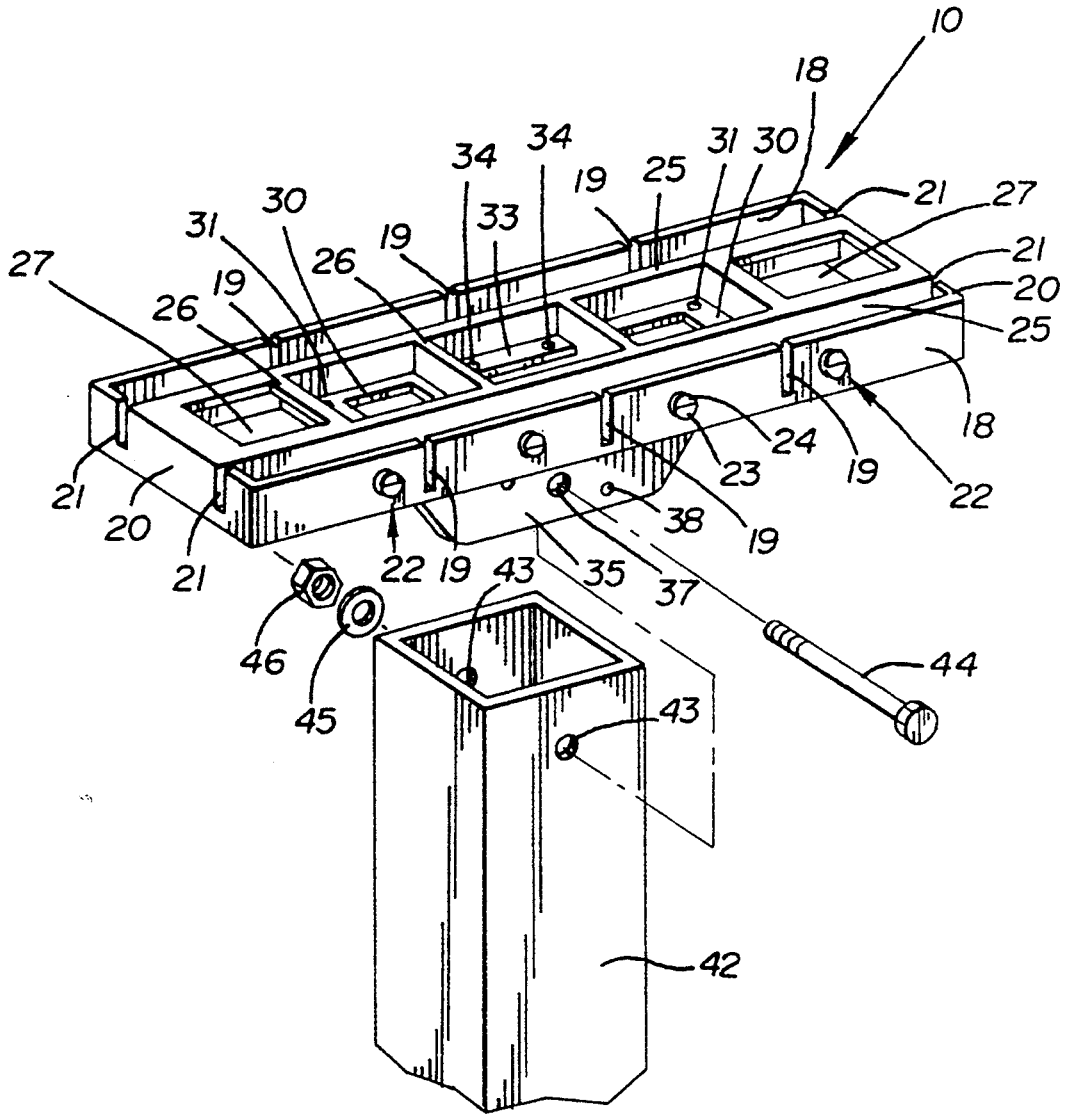
FIG. 5 is an exploded perspective view showing the mounting bracket depicted in FIG. 1 and a stanchion in the form of a hollow post.

The bottom of bracket 10 is shown in FIGS. 3, 4 and 5 and includes a plurality of rib members 28 which extend laterally between each rib member 25 and its adjacent side wall 18. Thus, rib members 28 are generally parallel to end walls 20 and are longitudinally spaced to form a plurality of compartments 29 between adjacent rib members 28 and between the end rib members 28 and their adjacent end wall 20. Like compartments 27, compartments 29 serve no functional purpose other than to save plastic material to reduce the manufacturing cost of bracket 10. However, rib members 28 do provide the necessary strength for bracket 10 as it is attached to mailbox 11 in a manner to be hereinafter described. In particular, as will become evident, rib members 28 are preferably longitudinally spaced so as to be adjacent to, or otherwise aligned with, lug members 22 to provide the necessary strength to side walls 18 when being attached to mailbox 11.

The bottom of the two rib members 26 adjacent to end walls 20 are each provided with a generally horizontal shelf 30. Each shelf 30 is shown as having two apertures 31 therein with reinforcing collars 32 extending apertures 31 to a point lower than shelves 30 thereby establishing apertures 31 with more length than had they merely extended through shelves 30. Similar shelves 33 extend inwardly within the central compartment of compartments 27 from ribs 25 and are likewise each provided with two through apertures 34 (FIG. 1). Although not shown in FIG. 3, collars similar to collars 32 may also be provided at the bottom of apertures 34.

The bottom surface of bracket 10 is thus defined by the bottom of rib members 25, 26 and 28 and their associated shelves 30 and 33. The eight apertures 31, 34 can serve, in a manner to be hereinafter described, to mount the bottom of bracket 10 to the top of a mailbox stanchion.

To further assist in the ability of bracket 10 to be mountable to a wide variety of stanchions, mounting flanges 35 depend from the bottom thereof, preferably from the bottom of rib members 25. Thus, flanges 35 extend longitudinally along bracket 10 and are laterally spaced from each other by a distance approximating the spacing between rib members 25. Reinforcing gussets 36 extend downwardly from side walls 18 to flanges 35 to provide lateral support to flanges 35. Flanges 35 are provided with aligned generally centrally located bores 37 and are also provided with offset apertures 38, bores 37 and apertures 38 being utilized, in a manner now to be described, to attach bracket 10 to various forms of stanchions.

As shown in FIG. 1, one form of stanchion to which bracket 10 is readily mountable is a conventional generally square post 39 sometimes known as a 4 by 4 post. One manner in which to mount bracket 10 to post 39 is to position bracket 10 on top of post 39 with flanges 35 straddling the same. Thus, it is preferred that flanges 35 be laterally spaced by a distance approximately equivalent to the size of post 39. Then screws 40 may be inserted through apertures 38 to firmly position bracket 10 on post 39. Alternatively, screws can be inserted through apertures 34 in the bottom of bracket 10 to be received in the top of post 39. Of course, for a totally rigid connection, bracket 10 may be affixed to post 39 at both of the aforesaid locations.

As shown in FIG. 4, if post 39 is of the type having a lateral cross-arm 41 extending horizontally therefrom or, for that matter with any stanchion having an upper horizontal conventional 2 by 4 member such as arm 41 at the top thereof, again screws 40 may be inserted through apertures 38 to affix bracket 10 thereto. Likewise, the bottom of bracket 10 may be affixed to the top of arm 41 by means of screws both through aperture 34 as well as apertures 31, as desired.

Another stanchion often encountered is the square, 4 by 4, post 42 shown in FIG. 5. Post 42 has aligned apertures 43 and when bracket 10 is positioned on the top of post 42, bores 37 in flanges 35 are aligned therewith. Then, a carriage bolt 44 may be positioned through bores 37 and apertures 43, and a washer 45 and nut 46 applied thereto to affix bracket 10 on post 42.

It should thus be appreciated that in view of the features of bracket 10 as previously described, it is readily mountable to most all conventional stanchions and with only a minimal amount of jury-rigging, to essentially all forms of stanchions. For example, a separate length of 4 by 4 may be attached to bracket 10 by any of the means described, and then that 4 by 4 may be attached to a stanchion of unconventional configuration.

Similarly, the top of bracket 10 is readily adapted to receiving a wide variety of mailbox configurations. For example, a standard mailbox can be attached to bracket 10 by merely snap fitting its generally recessed bottom over lug members 22 and thereby position the recessed bottom around side walls 18 and end walls 20 of bracket 10. Alternatively, a board can be fitted within the recessed bottom of the standard mailbox and attached to bracket 10 via screws extending upwardly through apertures 31 and/or 34.

Preferably, bracket 10 is used with a specially designed mailbox 11 having a uniquely configured bottom surface 17 as shown in FIG. 2. Bottom surface 17 includes a generally horizontal bottom wall 47, the top thereof defining the mail-supporting surface for mailbox 11. Laterally spaced outer flanges 48 depend from and extend longitudinally along bottom wall 47, the front ends of flanges 48 being attached to a front plate 49 which depends from and extends laterally across bottom wall 47. The rear ends of flanges 48 are attached to lip members 50 which extend downwardly from mailbox rear wall 15. A plurality of longitudinally spaced gussets 51 extend from the lower end of mailbox side walls 13 to each outer flange 48 and together with front plate 49 and lip members 50 provide lateral support to flanges 48.

Also depending from and extending longitudinally along bottom wall 47 are laterally spaced inner flanges 52. Inner flanges 52 are not only spaced from each other but are also laterally inwardly spaced from outer flanges 48. Inner flanges 52, like outer flanges 48, extend from front plate 49 to lip members 50 and are laterally supported by a plurality of longitudinally spaced plate members 53 which extend laterally between inner flanges 52 and outer flanges 48. Lateral support for inner flanges 52 is also provided by longitudinally spaced rib members 54 extending laterally between inner flanges 52.

Each outer flange 48 is provided with a plurality of longitudinally spaced apertures 55 corresponding in number and in spacing to lug members 22 of bracket 10. With bracket 10 mounted on its stanchion, as previously described, mailbox 11 may be attached thereto simply by pushing it downwardly onto bracket 10. Upon placing side walls 18 of bracket 10 within outer flanges 48 and pressing downwardly, lug members 22 will snap into apertures 55, being assisted by the tapered surfaces 24 of lug members 22 riding along the inside of outer flanges 48 thereby firmly attaching mailbox 11 to bracket 10. At this time plate members 53 will be received in notches 19 of side walls 18 of bracket 10 and inner flanges 52 will be received within notches 21 of end walls 20 of bracket 10 such that the bottom surface of bracket 10 is essentially flush with the lower extremities of flanges 48 and 52. If for any reason it would ever be desired to remove mailbox 11 from bracket 10, outer flanges 48 can merely be manually spread laterally outwardly while at the same time lifting mailbox 11 off of bracket 10, lugs 22 thereby being released from apertures 55. Moreover, if while attached to bracket 10, mailbox 11 is struck by a blow, damage thereto is minimized because lugs 22 will merely pop out of apertures 55.

Mailbox 11 is also shown as being capable of being attached to stanchions which have not been provided with a bracket 10. To this end, as shown, outer flanges 48 can be wider than inner flanges 52, that is, depend down further away from bottom wall 47 than inner flanges 52. A plurality of longitudinally spaced screw holes 56 can then be provided near the lower end of outer flanges 48 which are preferably laterally spaced to receive a conventional 4 by 6 wooden member therebetween Such a wooden member can then be attached to mailbox 11, as by screws received through holes 56, and then the wooden member may be attached to the stanchion in a conventional manner.

Similarly, mailbox 11 is adapted to be attached to a wooden member of another conventional size, 4 by 4. To this end, inner flanges 52 are preferably laterally spaced to receive the 4 by 4 member therebetween and can be attached to the 4 by 4 via screws received through holes 57 longitudinally spaced along inner flanges 52. In this regard, lug apertures 55 assist the user in that access to the screws by screwdriver or other tool employed to mount the 4 by 4 can be had through apertures 55.

It should thus be evident that a mounting bracket and its companion mailbox constructed in accordance with the concepts of the present invention as just described accomplishes the objects of the present invention and otherwise substantially improves the art.

We claim:

1. In combination, a mailbox and a bracket for mounting the mailbox to a stanchion; the bracket having opposed side walls, opposed end walls, a bottom surface, means depending from said bottom surface to enable the bracket to be attached to the stanchion, and lug means on at least one of said walls to engage the mailbox; the mailbox having a bottom surface, and outer flanges spaced from each other and depending from said bottom surface to engage said lug means, inner flanges depending from said bottom surface and spaced from each other and from said outer flanges, and a plurality of spaced plate members extending between said inner flanges and said outer flanges.

2. The combination of claim 1 wherein said lug means includes lug members positioned on both of said opposed side walls.

3. The combination of claim 2 wherein said lug members include a tapered surface and a flat surface.

4. The combination of claim 2, said outer flanges having apertures therein, said apertures engaging said lug members.

5. The combination of claim 1 further comprising apertures in said bottom surface of the bracket, said apertures being adapted to receive fastening members so that the bracket may be attached to the stanchion.

6. The combination of claim 1 wherein said inner and outer spaced flanges have aligned bores therethrough.

7. The combination of claim 6 wherein the stanchion includes a hollow generally square post having aligned apertures therethrough, said aligned bores of said spaced flanges and said aligned apertures of the square post being alignable to receive means to fasten said flanges to the square post therethrough.

8. The combination of claim 6 wherein said spaced flanges have apertures therein, said apertures being adapted to receive fastening members so that the bracket may be attached to the stanchion.

9. The combination of claim 1 further comprising apertures in said outer flanges, said apertures being adapted to receive fastening members so that the mailbox may be attached to the stanchion.

10. The combination of claim 1 further comprising apertures in said inner flanges, said apertures being adapted to receive fastening members so that the mailbox may be attached to the stanchion.

11. The combination of claim 1, said end walls having spaced notches therein to receive said inner flanges when the bracket is attached to the mailbox.

12. The combination of claim 1, said side walls having spaced notches therein to receive said plate members when the bracket is attached to the mailbox.

13. The combination of claim 1 wherein said bottom surface of the bracket includes a shelf member having apertures therein.

14. The combination of claim 13 wherein the stanchion includes a generally square post and said apertures in said shelf member are adapted to receive means to affix the bracket to the post.

15. The combination of claim 13 wherein said bottom surface of the bracket includes an additional shelf member having apertures therein.

16. The combination of claim 15 wherein the stanchion includes a generally horizontal cross-arm and said apertures in said shelf member and said apertures in said additional shelf member are adapted to receive means to affix the bracket to the cross-arm.

* * * * *